US011538365B2

(12) United States Patent
Li

(10) Patent No.: US 11,538,365 B2
(45) Date of Patent: Dec. 27, 2022

(54) DISPLAY MODULE

(71) Applicant: BOE TECHNOLOGY GROUP CO., LTD., Beijing (CN)

(72) Inventor: Zhao Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 1182 days.

(21) Appl. No.: 16/075,288

(22) PCT Filed: Jan. 10, 2018

(86) PCT No.: PCT/CN2018/072022
§ 371 (c)(1),
(2) Date: Aug. 3, 2018

(87) PCT Pub. No.: WO2018/205670
PCT Pub. Date: Nov. 15, 2018

(65) Prior Publication Data

US 2020/0286409 A1 Sep. 10, 2020

(30) Foreign Application Priority Data

May 12, 2017 (CN) ..... 201710335814.4

(51) Int. Cl.
*G09F 9/30* (2006.01)
*G09F 11/32* (2006.01)
*G09F 11/00* (2006.01)

(52) U.S. Cl.
CPC ..... *G09F 9/301* (2013.01); *G09F 11/325* (2013.01); *G09F 2011/0009* (2013.01)

(58) Field of Classification Search
CPC ..... G09F 9/301; G09F 11/325; G09F 2011/0009; G06F 1/1652; G06F 2203/04102
See application file for complete search history.

(56) References Cited

U.S. PATENT DOCUMENTS

2016/0205791 A1* 7/2016 Kim ..... G06F 1/1652 361/679.01
2016/0239050 A1 8/2016 Kim et al.
(Continued)

FOREIGN PATENT DOCUMENTS

CN 104536531 A 4/2015
CN 104851366 A 8/2015
(Continued)

OTHER PUBLICATIONS

First Office Action for CN Appl. No. 201710335814.4, dated Jul. 19, 2019.
(Continued)

*Primary Examiner* — Joe H Cheng
(74) *Attorney, Agent, or Firm* — Dinsmore & Shohl LLP

(57) ABSTRACT

The present disclosure relate to a display module, comprising: a flexible panel, wherein bumps are formed along two opposing sides of the flexible panel respectively, and a size of the bumps in a thickness direction of the flexible panel is larger than a thickness of the flexible panel; two curled slide rails arranged opposite to and in parallel with each other, wherein each slide rail has a groove for receiving the bump that extends along a curling direction of the slide rail, and for each groove, a groove entry for entering the groove is formed at one end of a respective slide rail; the slide rails and a space therebetween form a receiving rail for receiving the flexible panel; each of the bumps is able to enter a respective groove of the slide rail through the groove entry of the groove and move along the groove where the bump resides.

13 Claims, 5 Drawing Sheets

(56) References Cited

U.S. PATENT DOCUMENTS

| | | | | |
|---|---|---|---|---|
| 2016/0363960 | A1* | 12/2016 | Park | G09F 9/301 |
| 2017/0031388 | A1* | 2/2017 | Han | H01L 27/3244 |
| 2018/0017994 | A1* | 1/2018 | Xu | G09F 11/02 |

FOREIGN PATENT DOCUMENTS

| | | | |
|---|---|---|---|
| CN | 105788461 | A | 7/2016 |
| CN | 106097896 | A | 11/2016 |
| CN | 106251779 | A | 12/2016 |
| CN | 106409147 | A | 2/2017 |
| CN | 107170370 | A | 9/2017 |

OTHER PUBLICATIONS

First Office Action in Chinese Appl. No. 201710335814.4, dated Nov. 30, 2018.

International Search Report and Written Opinion for International Appl. No. PCT/CN2018/072022, dated Apr. 10, 2018.

* cited by examiner

DISPLAY MODULE

CROSS-REFERENCE TO RELATED APPLICATIONS

The present application claims priority under 35 U.S.C. § 371 to International Patent Application No. PCT/CN2018/072022 filed on Jan. 10, 2018, which claims priority to Chinese Application for Patent No. 201710335814.4 filed on May 12, 2017. The disclosure of the present application is totally incorporated herein by reference for all purposes.

TECHNICAL FIELD

Embodiments of the present disclosure relate to a display module.

BACKGROUND

For an existing rollable flexible display apparatus, when a flexible panel is curled on a surface of a reel, the flexible panel is curled on the surface in layers, and contacts and scrubs exist between the flexible panel in layers, which results in a damage in the flexible panel, thereby shortening a life time of the flexible display apparatus.

SUMMARY

One aspect of the present disclosure provides a display module, comprising: a flexible panel, wherein bumps are formed along two opposing sides of the flexible panel respectively, and a size of the bumps in a thickness direction of the flexible panel is larger than a thickness of the flexible panel; two curled slide rails arranged opposite to and in parallel with each other, wherein each of the two curled slide rails has a groove that extends along a curling direction of the slide rail for receiving a respective bump of the bumps, and for each groove, a groove entry for entering the groove is formed at one end of a respective slide rail of the two curled slide rails, wherein the two curled slide rails and a space therebetween form a receiving rail for receiving the flexible panel; wherein each of the bumps is able to enter a respective groove of a respective slide rail of the two curled slide rails through the groove entry of the groove and move along the groove where the bump resides, so as to drive the flexible panel to be curled and received within the receiving rail and drive the flexible panel to be pulled out from the receiving rail.

In some embodiments, each of the two curled slide rails is at least partially stacked and is stacked in layers at stacking positions, and there is a spacing between adjacent layers.

In some embodiments, each of the two curled slide rails is a helical slide rail.

In some embodiments, grooves of the two curled slide rails are arranged on facing sides of the two curled slide rails, and groove entries of the grooves of the two curled slide rails are arranged to face each other.

In some embodiments, each groove has a groove wall and a groove bottom, wherein the groove wall of the groove prevents a respective bump located within the groove from deviating from the groove entry of the groove, and in a depth direction from the groove entry to the groove bottom, widths defined by the groove wall in planes in parallel with the groove entry of the groove gradually increase or gradually increase and then decrease.

In some embodiments, each of the bumps has a bar shape and has a trapezoidal cross section, wherein a shorter upper base of the trapezoidal cross section is fixed to the flexible panel, and a shape of the groove matches the bump.

In some embodiments, each of the bump has a bar shape and has an arcuate cross section, wherein a chord of the trapezoidal cross section is fixed to the flexible panel, and a shape of the groove matches the bump.

In some embodiments, the bump is a chain-shaped bump formed by sequentially fixing a plurality of balls, and an inner wall of the groove forms a hollow cylinder, of which a cross section has an arcuate shape.

In some embodiments, the display module further comprises a reel. One of sides of the flexible panel, which is connected to a respective bump of the bumps, is fixed to the reel through a flexible connection. The reel rotates the flexible connection to be curled on a surface of the reel, and drives the bump to move along the groove so as to make the flexible panel curled and received within the receiving rail, and drives the flexible panel to be pulled out from the receiving rail.

In some embodiments, the display module further comprises a hollow axis cylinder, within which the receiving rail is located. The hollow axis cylinder has two bump entries for allowing the bumps to enter the grooves of the two curled slide rails, and there is a flexible panel entry between the two bump entries for allowing the flexible panel to enter the hollow axis cylinder.

In some embodiments, the bumps are made of an elastic material.

In some embodiments, a material of each of the bumps has a friction coefficient of less than 0.5, and/or a material of the inner wall of the groove has a friction coefficient of less than 0.5.

DETAILED DESCRIPTION

Figure 1:
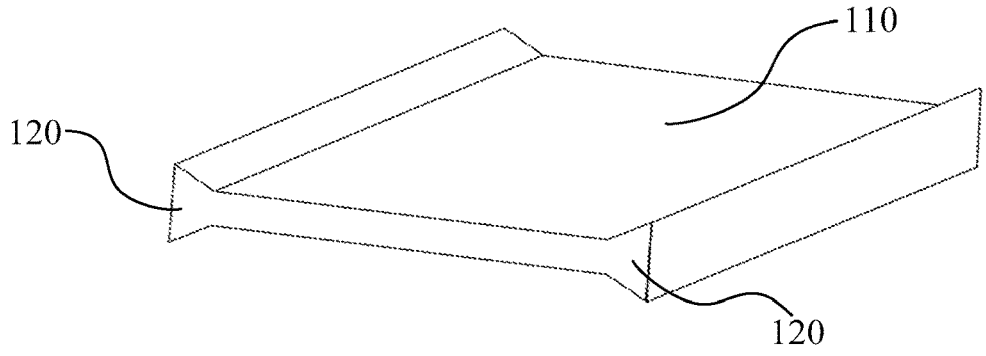
FIG. 1 is a perspective schematic diagram of a flexible panel and bumps of the display module according to an embodiment of the present disclosure.

The technical solutions in the embodiments of the present disclosure are clearly and completely described in the following with reference to the accompanying drawings in the embodiments of the present disclosure. It is obvious that the described embodiments are only a part of the embodiments of the present disclosure, and not all of the embodiments. All other embodiments obtained by a person of ordinary skill in the art without inventive effort based on the embodiments of the present disclosure fall into the scope of the disclosure.

As shown in FIGS. 1, 2, 3, 4, 5, 6, and 7, a display module according to an embodiment of the present disclosure comprises a flexible panel 110, wherein bumps 120 are formed along two opposing sides of the flexible panel respectively, and a size of the bumps 120 in a thickness direction of the flexible panel 110 is larger than a thickness of the flexible panel 110; two curled slide rails 200 arranged opposite to and in parallel with each other, wherein each of the slide rails 200 has a groove 210 that extends along a curling direction of the slide rail for receiving a respective bump of the bumps, and for each groove, a groove entry 211 for entering the groove is formed at one end of the slide rail; the two curled slide rails 200 and a space therebetween form a receiving rail for receiving the flexible panel; the bumps 120 can enter the grooves 210 from the groove entries of the grooves 210 of the two side rails and move along the grooves where the bumps 120 reside, so as to drive the flexible panel 110 to be curled and received within the receiving rail and drive the flexible panel 110 to be pulled out from the receiving rail.

Figure 2:
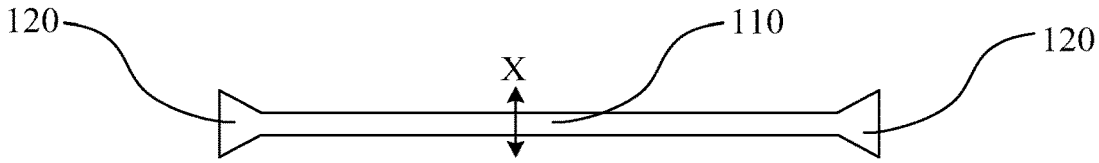
FIG. 2 is a cross-sectional schematic diagram of the flexible panel and the bumps as shown in FIG. 1.

The display module according to the embodiment of the present disclosure comprises a flexible panel and two curled slide rails, wherein bumps are formed along two opposing sides of the flexible panel respectively, and a size of the bumps in a thickness direction of the flexible panel is larger than a thickness of the flexible panel. In FIG. 2, a thickness direction of the flexible panel is denoted by an arrow and X. The two curled slide rails are arranged opposite to and in parallel with each other. Each of the slide rails has a groove for receiving the bump that extends along a curling direction of the slide rail. For each groove, a groove entry for entering the groove is formed at one end of the slide rail. The two curled slide rails and a space therebetween form a receiving rail for receiving the flexible panel. The bumps can enter the grooves through the groove entries of the grooves of the two side rails and move along the grooves where the bumps reside, so as to drive the flexible panel to be curled and received within the receiving rail and drive the flexible panel to be pulled out from the receiving rail. The bumps are respectively arranged along the two opposing sides of the flexible panel, and a size of the bumps in a thickness direction of the flexible panel is larger than a thickness of the flexible panel. The bumps are received within the grooves of the slide rails, and then a size of the slide rail in a thickness direction of the flexible panel is larger than a thickness of the flexible panel. When the bumps are curled and received within the groove, if the slide rails do not stack, the flexible panel is curled and received within the receiving rails in a single layer and there is no problem of contacts and scrubs; if the flexible panel is curled and received within the receiving rails in multiple layers, the bumps have a large size in a thickness direction of the flexible panel, such that a spacing also exists between the flexible panel in adjacent layers, which avoids or reduces, to a great extent, the problem of contacts and scrubs between the flexible panel in adjacent layers and protects the flexible panel.

Figure 5:
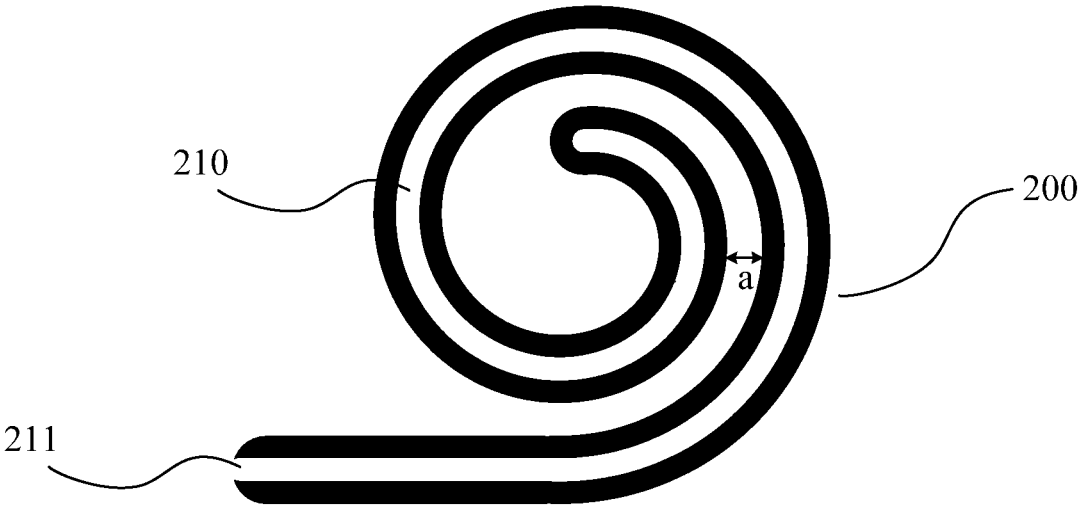
FIG. 5 is a schematic diagram of one side of the slide rail on which the groove is provided in FIG. 4.
Figure 6:
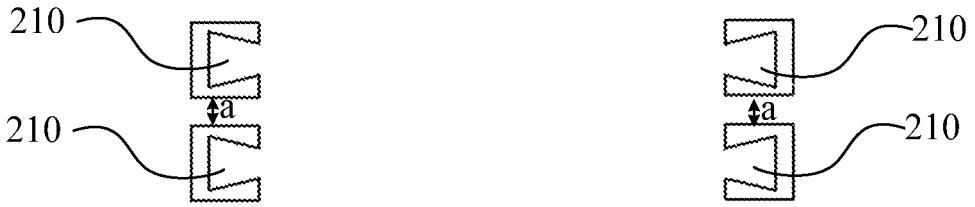
FIG. 6 is a schematic diagram of the slide rails as shown in FIG. 3 at stacking positions.
Figure 7:
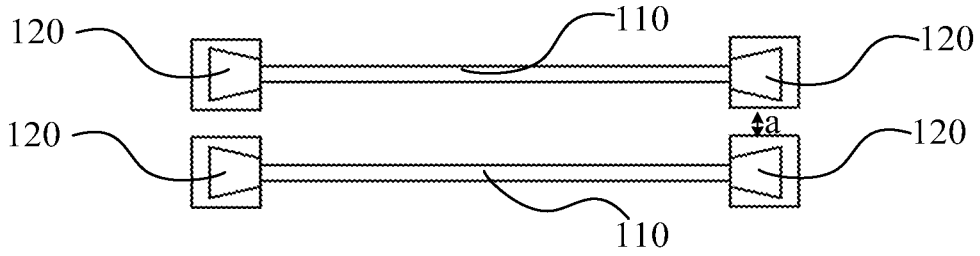
FIG. 7 is a schematic diagram that the bumps are received within the grooves of the slide rails as shown in FIG. 3.

Regarding a specific pattern of the slide rail, each of the curled slide rails may be at least partially stacked and be stacked in layers at stacking positions, and there is a spacing a between adjacent layers. As shown in FIGS. 5, 6, and 7, each of the slide rails 200 is stacked in layers at stacking positions, and there is a spacing a between adjacent layers. In this way, as shown in FIG. 5, when the flexible panel is curled and received within the receiving rail which is formed by the two curled slide rails and a space therebetween, there is a large spacing between the flexible panel 110 in adjacent layers at the stacking positions, which further avoids or reduces, to a great extent, the problem of contacts and scrubs between the flexible panel in adjacent layers and protects the flexible panel. Meanwhile, the extent of curling of the flexible panel is less, which reduces the occurrence of a damage caused by an excessive curling of the flexible panel.

Figure 3:
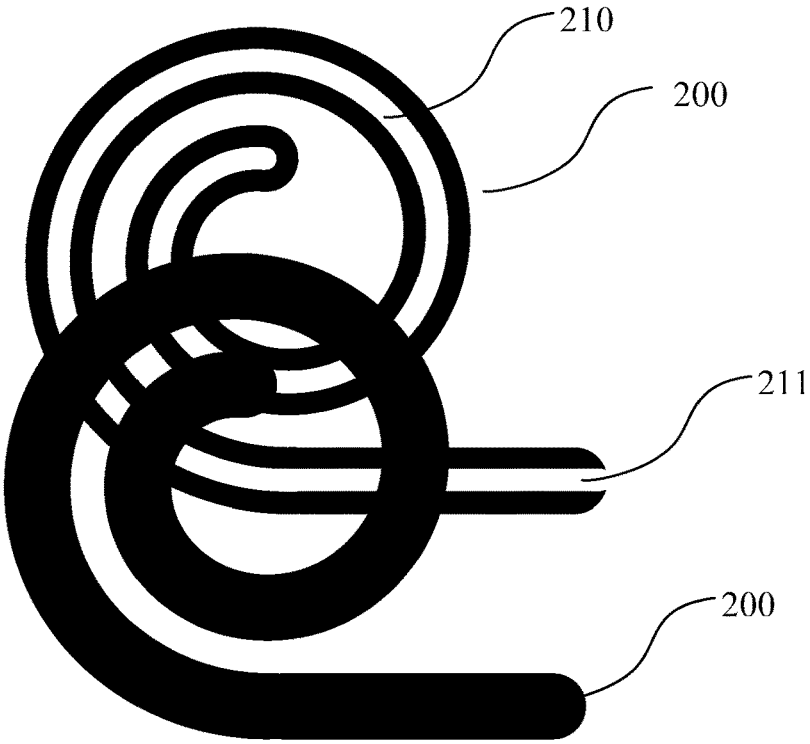
FIG. 3 is a schematic diagram of the slide rails and their positions of the display module according to an embodiment of the present disclosure.
Figure 4:
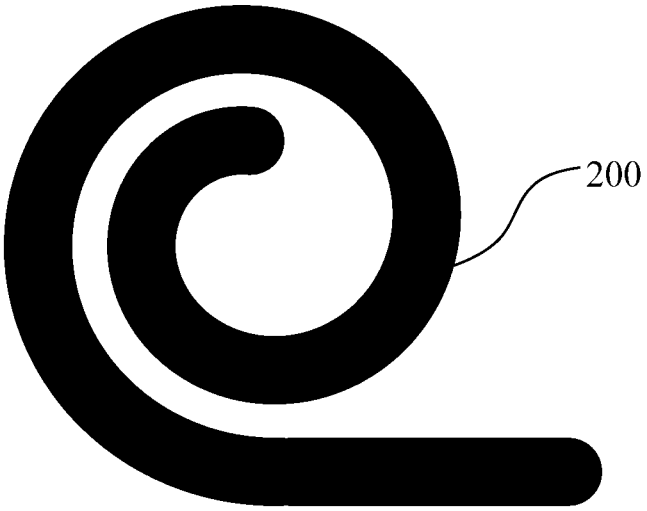
FIG. 4 is a schematic diagram of the slide rail of which the groove is not exposed in FIG. 3.

In some embodiments, as shown in FIGS. 3, 4, and 5, each of the slide rails 200 is a helical slide rail. The helical slide rail is an instance where the slide rail has a spacing between stacking positions.

Regarding positions of the grooves of the slide rails, the grooves 210 may be arranged on opposite sides of the two slide rails 200 as shown in FIGS. 6 and 7, and groove entries of the grooves of the two slide rails are arranged to face each other. In this way, the bumps are received within the grooves, and no contact between the flexible panel and the slide rails will result in no problem of contacts and scrubs between the flexible panel and the slide rails, and the flexible panel is protected.

To enable the groove to still receive the bump in case where the groove entry of the groove is facing down, and a groove wall of the groove prevents the bump located within the groove from deviating from the groove entry of the groove, and in a depth direction from the groove entry to the groove bottom, widths defined by the groove wall in planes in parallel with the groove entry of the groove gradually increase or gradually increase and then decrease. The groove and groove wall having such a structure such as to guarantee that the groove is able to still receive the bump when the groove entry is facing down, so as to guarantee the bump to be received within the groove.

In some embodiments, the bumps may have various shapes, and corresponding grooves have matching shapes. As shown in FIGS. 2, 6, and 7, the bump 120 has a bar shape, and has a trapezoidal cross section, of which a shorter upper base is fixed to the flexible panel. A shape of the groove 210 matches the bump 120.

In some embodiments, the bump has a bar shape, and has an arcuate cross section (not shown), of which a chord is fixed to the flexible panel. A shape of the groove matches the bump.

Figure 8:
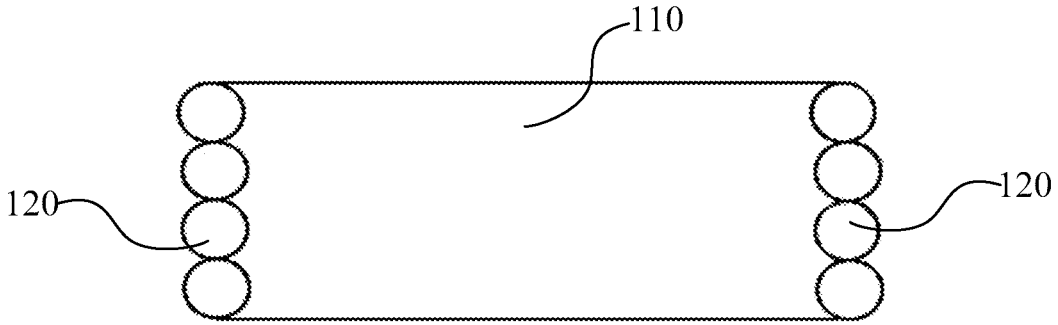
FIG. 8 is a schematic diagram of a flexible panel and bumps of the display module according to another embodiment of the present disclosure.
Figure 9:
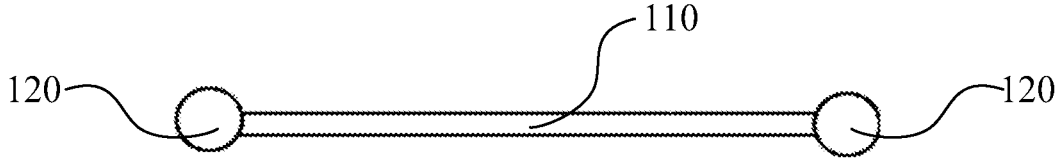
FIG. 9 is a cross-sectional schematic diagram of the flexible panel and the bumps as shown in FIG. 8.

In some embodiments, as shown in FIGS. 8 and 9, the bump 120 is a chain-shaped bump formed by sequentially fixing a plurality of balls, and an inner wall of the groove forms a hollow cylinder, of which a cross section has an arcuate shape.

The shapes of the aforementioned bumps and grooves enable the bumps to be still received in case where the groove entries of the grooves are facing down, so as to guarantee that the bumps are received by the grooves.

Figure 10:
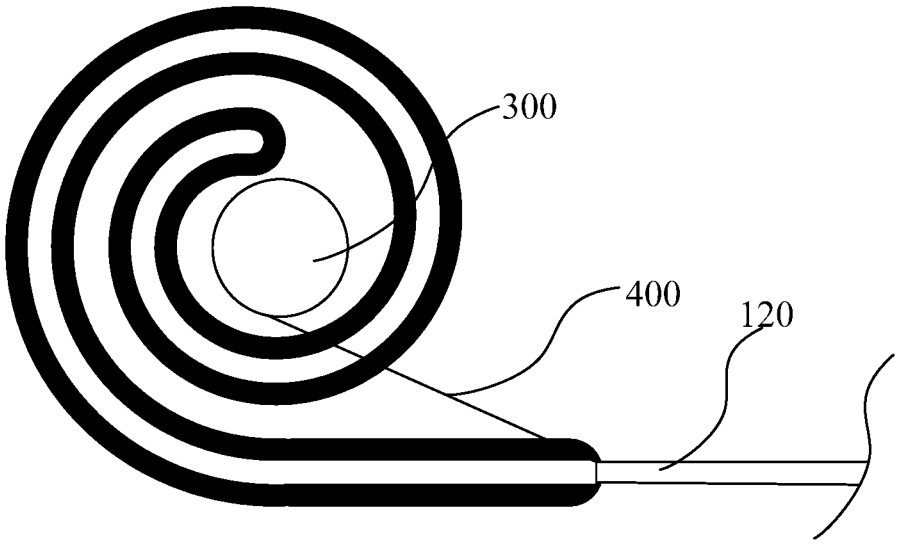
FIG. 10 is a schematic diagram that the flexible panel is pulled out from the receiving rail in the display module according to the present disclosure.
Figure 11:
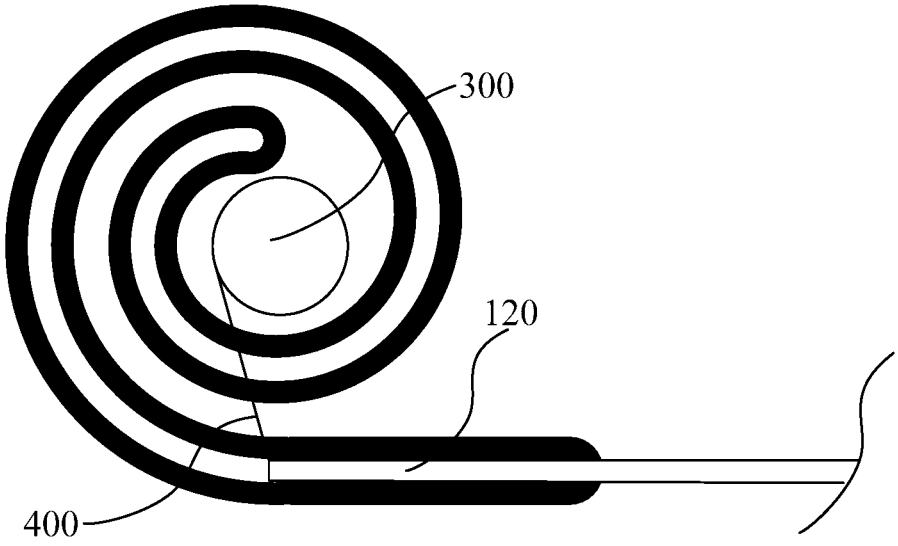
FIG. 11 is a schematic diagram of the process that the flexible panel is received by the receiving rail in the display module according to the present disclosure.

To cause the flexible panel to be received in or to be pulled out from the receiving rail, as shown in FIGS. 10 and 11, the display module may further comprise a reel 300. One of sides of the flexible panel, which is connected to the bump, is fixed to the reel 300 through a flexible connection 400. The reel 300 rotates the flexible connection 400 to be curled on a surface of the reel, and drives the bump 120 to move along the groove 210 so as to make the flexible panel 110 curled and received within the receiving rail and drives the flexible panel to be pulled out from the receiving rail.

The reel is fixed to the flexible panel. The presence of the reel causes the user to operate the reel to move along a curling direction of the slide rail, so as to drive the bump to move along the groove, which facilitates the operation of causing the flexible panel to be curled and received within the receiving rail and be pulled out from the receiving rail.

Figure 12:
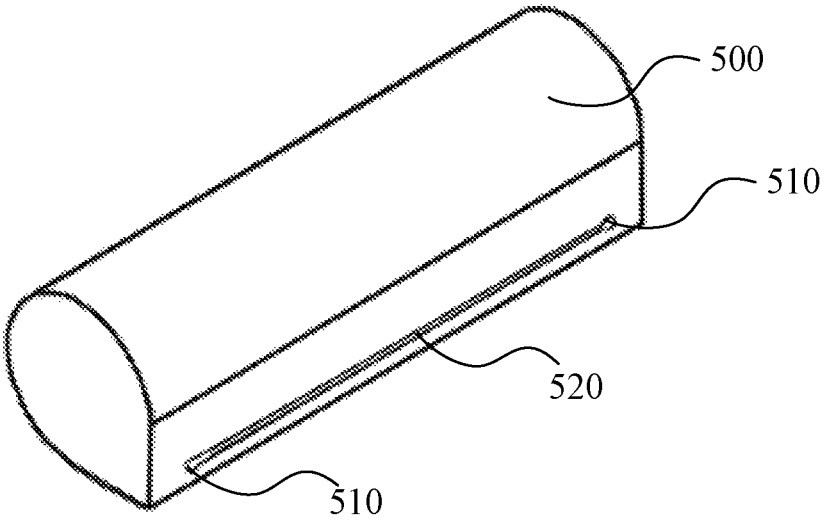
FIG. 12 is a perspective schematic diagram of the axis cylinder of the display module according to the present disclosure.

To better guard the flexible panel, as shown in FIG. 12, the display module further comprises a hollow axis cylinder 500, within which the receiving rail is located. The axis cylinder 500 has bump entries 510 for allowing the bumps to enter the grooves of the slide rails, and there is a flexible panel entry 520 between the two bump entries for allowing the flexible panel to enter the axis cylinder.

The axis cylinder has bump entries and a flexible panel entry for allowing the flexible panel to enter and exit the axis cylinder. The presence of the axis cylinder can serve a guard function for the flexible panel curled and received within the receiving rail.

To achieve a curling of the flexible panel, the bumps located on two opposing sides also need to be curled. Therefore, the bumps are bumps made of an elastic material.

In this way, the bump may deform when the bump moves along the groove where it resides, and be curled along the groove where it resides.

To reduce a resistance of movement of the bump within the groove, a material of the bump has a friction coefficient of less than 0.5, and/or a material of the inner wall of the groove has a friction coefficient of less than 0.5.

In this way, the bump has a relatively small resistance when moving within the groove, the process of causing the flexible panel to be curled and received within the receiving rail and be pulled out from the receiving rail will become relatively smooth.

It is apparent that those skilled in the art can make various modifications and variations to the embodiments of the present disclosure without departing from the spirit and scope of the disclosure. Thus, it is intended that the present invention cover the modifications and the modifications, if these modifications and variations to the present disclosure fall into the scope of the claims of the present disclosure and equivalent technologies thereof.

What is claimed is:

1. A display module, comprising:

a flexible panel, wherein bumps are formed along two opposing sides of the flexible panel respectively, and a size of the bumps in a thickness direction of the flexible panel is larger than a thickness of the flexible panel;

two curled slide rails arranged opposite to and in parallel with each other, wherein each of the two curled slide rails has a groove that extends along a curling direction of the slide rail for receiving a respective bump of the bumps, and for each groove, a groove entry for entering the groove is formed at one end of a respective slide rail of the two curled slide rails, wherein the two curled slide rails and a space therebetween form a receiving rail for receiving the flexible panel;

wherein each of the bumps is able to enter a respective groove of a respective slide rail of the two curled slide rails through the groove entry of the groove and move along the groove where the bump resides, so as to drive the flexible panel to be curled and received within the receiving rail and drive the flexible panel to be pulled out from the receiving rail, and wherein each of the two curled slide rails is at least partially stacked and is stacked in layers at stacking positions, and there is a spacing between adjacent layers.

2. The display module according to claim 1, wherein each of the two curled slide rails is a helical slide rail.

3. The display module according to claim 1, wherein grooves of the two curled slide rails are arranged on facing sides of the two curled slide rails, and groove entries of the grooves of the two curled slide rails are arranged to face each other.

4. The display module according to claim 1, wherein each groove has a groove wall and a groove bottom, wherein the groove wall of the groove prevents a respective bump located within the groove from deviating from the groove entry of the groove, and in a depth direction from the groove entry to the groove bottom, widths defined by the groove wall in planes in parallel with the groove entry of the groove gradually increase or gradually increase and then decrease.

5. The display module according to claim 4, wherein each of the bumps has a bar shape and has a trapezoidal cross section, wherein a shorter upper base of the trapezoidal cross section is fixed to the flexible panel, and a shape of the groove matches the bump.

6. The display module according to claim 4, wherein each of the bump has a bar shape and has an arcuate cross section, wherein a chord of the trapezoidal cross section is fixed to the flexible panel, and a shape of the groove matches the bump.

7. The display module according to claim 4, wherein each of the bumps is a chain-shaped bump formed by sequentially fixing a plurality of balls, and an inner wall of the groove forms a hollow cylinder, of which a cross section has an arcuate shape.

8. The display module according to claim 1, further comprising:

a reel, wherein one of sides of the flexible panel, which is connected to a respective bump of the bumps, is fixed to the reel through a flexible connection; and wherein the reel rotates the flexible connection to be curled on a surface of the reel, and drives the bump to move along the groove so as to make the flexible panel curled and received within the receiving rail, and drives the flexible panel to be pulled out from the receiving rail.

9. The display module according to claim 1, further comprising:

a hollow axis cylinder, wherein the receiving rail is located within the hollow axis cylinder;

wherein the hollow axis cylinder has two bump entries for allowing the bumps to enter the grooves of the two curled slide rails; and wherein there is a flexible panel entry between the two bump entries for allowing the flexible panel to enter the hollow axis cylinder.

10. The display module according to claim 1, wherein the bumps are made of an elastic material.

11. The display module according to claim 1, wherein a material of the bumps has a friction coefficient of less than 0.5.

12. The display module according to claim 11, wherein a material of the inner wall of the grooves has a friction coefficient of less than 0.5.

13. The display module according to claim 1, wherein a material of the inner wall of the grooves has a friction coefficient of less than 0.5.

* * * * *